US008087872B2

(12) United States Patent
Mehra et al.

(10) Patent No.: US 8,087,872 B2
(45) Date of Patent: Jan. 3, 2012

(54) STEAM SEAL SYSTEM

(75) Inventors: Mahendra Singh Mehra, Bangalore Karnataka (IN); Nestor Hernandez Sanchez, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 92 days.

(21) Appl. No.: 12/729,317

(22) Filed: Mar. 23, 2010

(65) Prior Publication Data

US 2011/0236177 A1 Sep. 29, 2011

(51) Int. Cl.
*F01D 11/00* (2006.01)

(52) U.S. Cl. ..... 415/1; 415/26; 415/174.2; 415/174.5; 415/231; 416/1; 416/61

(58) Field of Classification Search ..... 415/1, 174.2, 415/174.5, 231, 13, 26; 416/1, 61
See application file for complete search history.

(56) References Cited

U.S. PATENT DOCUMENTS

| | | | | |
|---|---|---|---|---|
| 3,604,206 | A | 9/1971 | Baily | |
| 5,344,160 | A | 9/1994 | Scaarlata et al. | |
| 5,503,405 | A * | 4/1996 | Jewett et al. | 415/170.1 |
| 6,786,487 | B2 | 9/2004 | Dinc et al. | |
| 6,957,945 | B2 * | 10/2005 | Tong et al. | 415/1 |
| 7,040,861 | B2 * | 5/2006 | Clifford et al. | 415/174.2 |
| 2003/0102630 | A1 | 6/2003 | Dinc et al. | |
| 2008/0169616 | A1 | 7/2008 | Awtar et al. | |

FOREIGN PATENT DOCUMENTS

JP 62199902 9/1987

* cited by examiner

*Primary Examiner* — Igor Kershteyn
(74) *Attorney, Agent, or Firm* — Sutherland Asbill & Brennan LLP

(57) ABSTRACT

The present application provides a variable steam seal system for use with a steam turbine. The variable steam seal system may include a seal steam header, a first pressure section, a first pressure seal positioned about the first pressure section, and a flow path through the first pressure seal and extending to the seal steam header. The first pressure seal may include a moveable seal packing ring for varying the flow path through the first pressure seal to the seal steam header.

17 Claims, 4 Drawing Sheets

STEAM SEAL SYSTEM

TECHNICAL FIELD

The present application relates generally to steam turbine systems and more particularly relates to a substantially constant self-sealing load point steam system so as to improve performance over a range of loads.

BACKGROUND OF THE INVENTION

Shaft packings are required to provide sealing of the turbine rotor or shaft between the turbine shells or the exhaust hood and the atmosphere. During normal turbine operations, the endpackings can be divided into two distinct groups, pressure packings and vacuum packings. Pressure packings generally prevent steam from blowing out into the turbine room. Vacuum packings generally seal against the leakage of air into the condenser. Known steam seal systems largely address these issues by utilizing the steam leaking from the pressure packings to help seal the vacuum packings.

Current steam seal systems generally have a single set point sub-optimized design. For example, these designs may provide an unfired guarantee loading with a self-sealing load point ("SSLP") of about seventy percent (70%). When a steam turbine "self seals", the terms generally refer to the condition where the pressure packing seal steam flow is sufficient to pressurize and seal the vacuum packings. In higher load conditions such as a supplementary firing, however, the pressure packing steam flow going to the steam seal header increases but the vacuum packing requirement may not vary such that the SSLP may be as low as about thirty percent (30%). The additional steam coming from the pressure packings into the steam seal system thus may be dumped to the condenser without extracting any work. Similarly during low load operations, the pressure packing steam flow may be reduced significantly from the design point, but the vacuum packing steam flow requirements again may not vary. In such a situation, the steam seal system may not be sufficient and an extra flow may be required from the throttle steam at a significant loss in performance.

There is a desire therefore for an improved steam seal system so as to maintain a substantially consistent self-sealing load point across numerous loading situations. Such a constant self-sealing load point should improve overall power output and provide heat rate improvement.

SUMMARY OF THE INVENTION

The present application thus provides a variable steam seal system for use with a steam turbine. The variable steam seal system may include a seal steam header, a first pressure section, a first pressure seal positioned about the first pressure section, and a flow path through the first pressure seal and extending to the seal steam header. The first pressure seal may include a moveable seal packing ring for varying the flow path through the first pressure seal to the seal steam header.

The present application further provides a method of operating a steam turbine at a substantially constant self-sealing load point. The method may include the steps of monitoring the load on the steam turbine, maneuvering a seal packing ring to provide a minimum clearance through a pressure seal during a high load operation, and maneuvering the seal packing ring to provide a maximum clearance through the pressure seal during a low load operation.

The present application further provides a variable steam seal system for use with a steam turbine. The variable steam seal system may include a seal steam header, a high pressure section with a high pressure seal, a low pressure section with a low pressure seal, a first flow path through the high pressure seal and extending to the seal steam header, and a second flow path through the low pressure seal and extending to the seal steam header. The high pressure seal and the low pressure seal may include a moveable seal packing ring for varying the flow paths through the high pressure seal and the low pressure seal to the seal steam header.

These and other features and improvement of the present application will become apparent to one of ordinary skill in the art upon review of the following detailed description when taken in conjunction with the several drawings and the appended claims.

DETAILED DESCRIPTION

Figure 1:
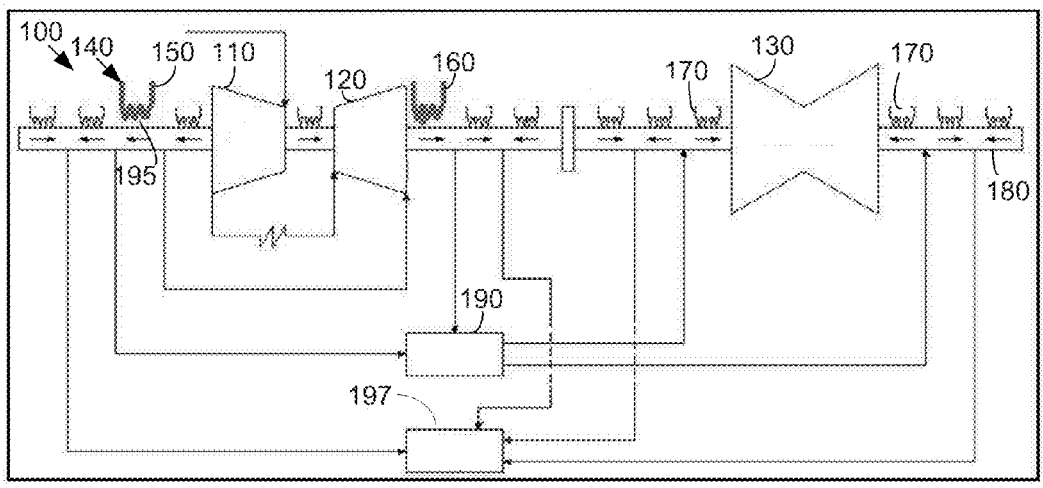
Fig. 1 (PRIOR ART)
FIG. 1 is a schematic view of a known steam turbine system with a single set point steam seal system.

Referring now to the drawings, in which like numerals refer to like elements throughout the several views, FIG. 1 shows a schematic view of a known steam turbine system 100. The steam turbine system 100 includes a high pressure section 110, an intermediate section 120, and a low pressure section 130. Generally described, the steam turbine system 100 may include a steam seal system 140. The steam seal system 140 may include a number of high pressure seals 150, intermediate pressure seals 160, and low pressure seals 170. The seals 150, 160, 170 may be positioned about a rotor or shaft 180. Steam may be supplied to the seals by means of a seal steam header 190 and the like. In this example, the seals may have a constant clearance packing as is described above for a constant flow path 195 therethrough. The seals may be designed for unfired guarantee load with SSLP of about seventy percent (70%). A steam packing exhauster 197 also may be used herein. Other designs may be used herein.

Figure 2:
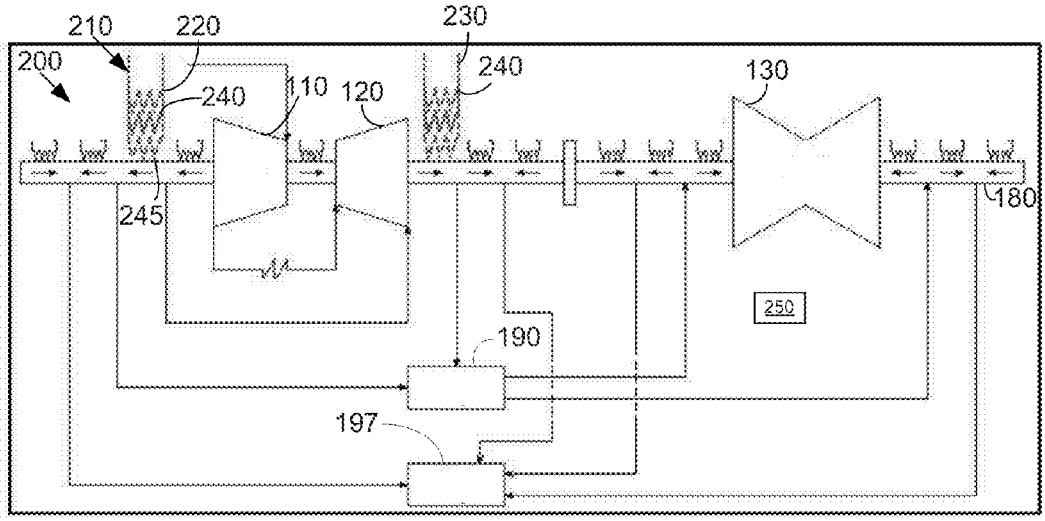
FIG. 2 is a schematic view of a variable steam seal system as is described herein.

FIG. 2 shows a steam turbine system 200 as may be described herein. The steam seal system 200 may include a variable steam seal system 210. The variable steam seal system 210 may be similar to the steam seal system 140 described above but with the high pressure seal 140 and the intermediate pressure seal 150 being replaced with a variable high pressure seal 220 and a variable intermediate pressure seal 230. Other seals may be replaced herein. The variable seals 220, 230 may include a movable seal packing ring 240 therein. The movable seal packing ring 240 may define a variable flow path 245 therethrough. The position of the moveable seal packing rings 240 may be based upon the load of the steam turbine system 200 as a whole as determined by a load sensor 250 or otherwise. The movable seal packing rings 240 thus may vary the flow to the seal steam header 190 so as to maintain the required or the desired SSLP over a range of loads.

Figure 3:
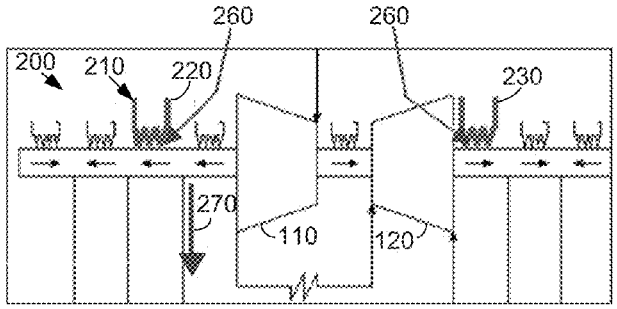
FIG. 3 is a schematic view of the variable steam seal system of FIG. 2 showing a minimum clearance.

For example, FIG. 3 shows the moveable seal packing rings 240 on the variable seals 220, 230 set at a minimum clearance position 260. The minimum clearance position 260 may maintain about a ninety percent (90%) SSLP at high load operations such as during supplementary firing and the like. The reduced steam flow passing through the moveable seal packing rings 240 in the minimum clearance position 260 may be diverted through a leak-off line 270 or otherwise diverted for doing useful work.

Figure 4:
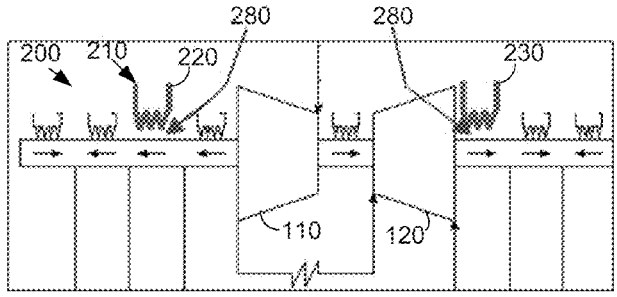
FIG. 4 is a schematic view of the variable steam seal system of FIG. 2 showing an intermediate clearance.
Figure 5:
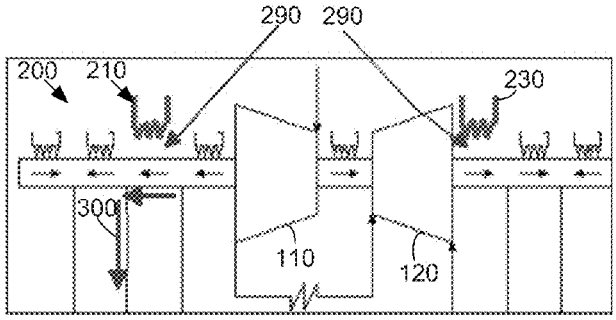
FIG. 5 is a schematic view of the variable steam seal system of FIG. 2 showing a maximum clearance.

FIG. 4 shows the moveable seal packing rings 240 at an intermediate clearance position 280. The intermediate clearance position 280 may maintain the typical ninety percent (90%) SSLP or otherwise at a guarantee (unfired) load, i.e., from about low load to about full load. Likewise, FIG. 5 shows the moveable seal packing rings 240 at a maximum clearance position 290. The maximum clearance position 290 may maintain the ninety percent (90%) SSLP or otherwise at low load operations meeting the LP seal flow requirements or otherwise so as to increase further the amount of steam passing therethrough. The leak-off steam also may be diverted via a leak-off line 300 to the seal steam header 190 or otherwise. Moreover, the sealing flow requirements for turning gear operations and the like may be reduced by closing the moveable seal packing rings 240.

The position of the moveable seal packing rings 240 thus may be varied based upon the overall load on the steam turbine system 200 or otherwise to maintain a constant self-sealing load point across numerous loading conditions. As a result, smaller boilers and/or other types of steam sources for the steam seal system 210 may be used herein. Such a constant self-sealing load point should improve overall power output and performance and also provide heat rate improvement.

Figure 6:
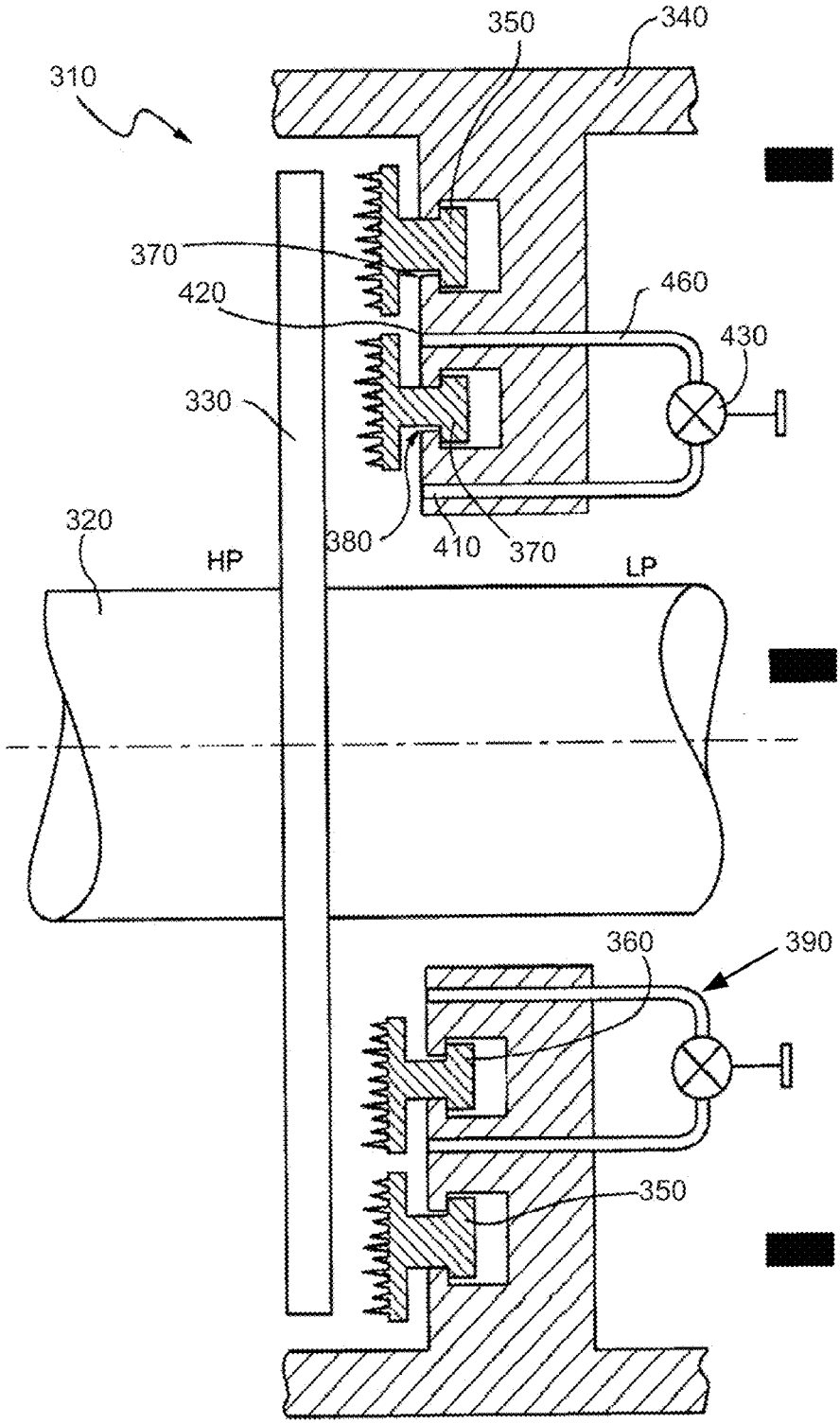
FIG. 6 shows a partial cross-sectional view of an actuating mechanism that may be used with the variable steam seal system of FIG. 2.

The moveable seal packing rings 240 may function via a pressure activated system, an electro-mechanical system, or otherwise. For example, commonly owned U.S. Patent Publication No. 2008/0169616 to Awtar, et al. shows a retractable seal system that may be used as the moveable seal packing rings 240. Specifically, an axial sealing arrangement 310 is shown in FIG. 6. The axial sealing arrangement 310 may include a rotor 320 with an axial plate 330 surrounded by a stator 340. A pair of annular seal rings 350, 360 ($R_1$, $R_2$ respectively) are mounted within the stator 340 such that a high pressure fluid may flow in a number of gaps 370, 380 to move the seal rings 350, 360 toward the rotor axial plate 330. At least one of the seal rings 350, 360 may incorporate a bypass circuit 390 that includes at least one pipe or conduit 400 extending from an inlet 410 at a location in the stator upstream of the seal rings 350, 360 to an outlet 420 downstream of the seal rings 350, 360, with at least one bypass control valve 430 located between the inlet and the outlet for controlling the flow through the bypass circuit.

When the valve 430 is opened, the bypass circuit 390 offers significantly less resistance to the flow as compared to the leakage between, for example, the seal ring 360 and the rotor axial plate 330. This results in a significant reduction in the pressure drop across the active seal ring, thus causing it to retract or open under the influence of a spring or other suitable actuator. Although a labyrinth packing seal is illustrated, it should be appreciated that this active retractable axial sealing arrangement 310 is applicable to all kinds of seals, including but not limited to brush seals, compliant plate seals, shingle seals, honeycomb seals, abradable seals, and the like.

Figure 7:
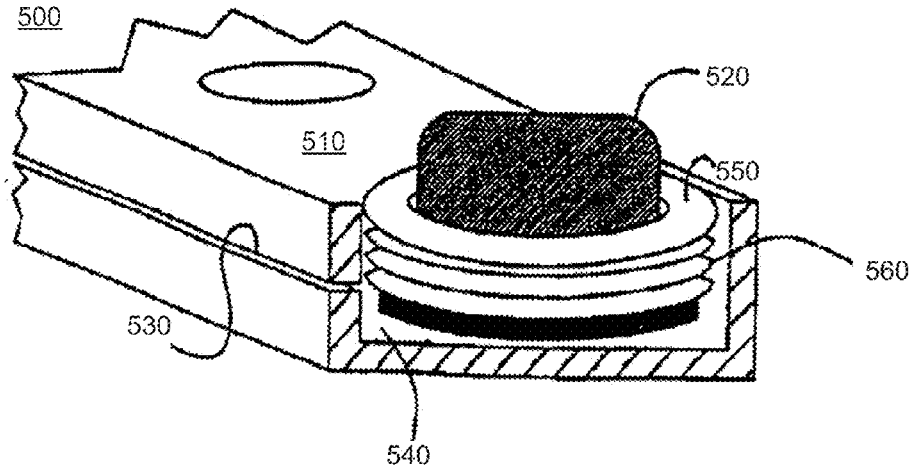
FIG. 7 shows a partial cross-sectional view of an alternative embodiment of an actuating mechanism that may be used with the variable steam seal system of FIG. 2.
Figure 8:
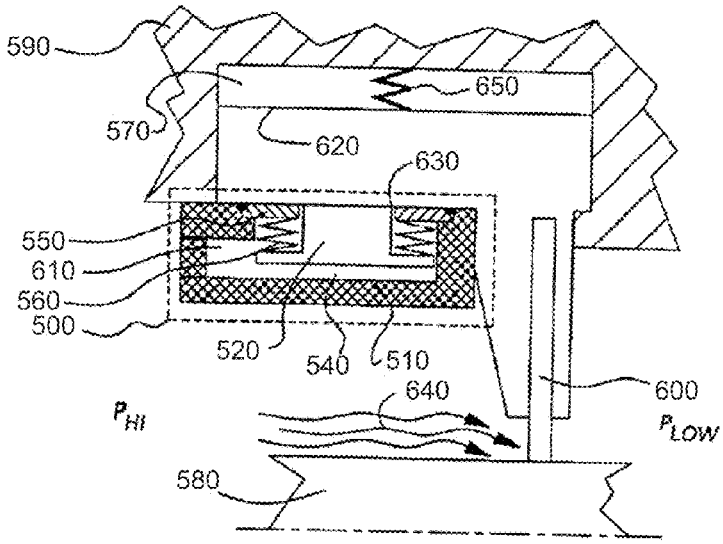
FIG. 8 shows a partial cross-sectional view of the actuating mechanism of FIG. 7.

Commonly owned U.S. Pat. No. 6,786,487 to Dinc, et al. shows an embodiment of another type of actuating mechanism, here an actuating mechanism 500. As is shown in FIGS. 7 and 8, the actuating mechanism 500 may include a housing 510 having at least one lifting button 520 disposed therein. A channel 530 may be disposed in fluid communication with at least one cavity 540. The lifting button 520 may be disposed within the cavity 540 such that the button 520 may be movable between a retracted position and an extended position upon the introduction of a pressurized medium, for example a gas source or steam source located internally or externally to a turbine. The actuating mechanism 500 may include at least one washer 550 concentrically disposed about the cavity 540 so as to restrict particulates from entering the areas between the lifting button 520 and the housing 510.

A compliant mechanism 560, for example, a bellows, may be secured to the washer 550 and the lifting button 520 so as to allow the compliant mechanism 560 to be radially displaced upon introduction of the pressurized medium and subsequently move a seal carrier 570 radially. "Compliant," as used herein, means that the structure of the compliant mechanism 560 yields under a force or pressure. The actuating mechanism 500 may be disposed in a turbine between a rotating member 580, for example a rotor, and a stationary housing, for example a turbine housing 590. The turbine housing 590 typically includes the seal carrier 570 disposed adjacent to the rotating member 580 so as to separate pressure regions on axially opposite sides of seal carrier 570. The carrier 570 typically includes, but is not limited to, at least one seal 600, for example, at least one brush seal bristle, disposed in a seal carrier 610. In addition, the actuating mechanism 500 may be coupled to a seal carrier top portion 620 and a seal carrier bottom portion 630.

A steam path 640 may pass between the rotating member 580 and the turbine housing 590. For example, the steam path 640 flows from the high pressure side towards the low pressure side. FIG. 8 shows the seal carrier 570 and accompanying seal 600 in a fully closed position. It will be appreciated that the seal carrier 570 and the accompanying seal 600 are movable between the fully closed position and a fully open position so as to alter the steam path 640 between the seal 600 and the rotating member 580.

In operation, the actuating mechanism 500 actuates the seal carrier 520 to lift, lower, or adjust the position of the seal carrier 520. For example, when the pressurized medium is introduced into the channel 610, a pressure load forces the seal carrier 520 radially upward so as to lift the seal 600 away from rotating member 580. As a result, the actuating mechanism 500 controls the flow in the fluid path 640 between the rotating member 580 and the turbine housing 590. Alternatively, the pressurized load may force the seal carrier 520 radially downward to keep the seal 600 disposed against the rotating member 580 or otherwise positioned. A spring 650 also may be used to return the seal carrier 520 or otherwise.

Other types of actuating mechanisms may be used herein so as to position the moveable seal packing rings 240 as desired. For example, the seal steam header 190 may include a number of feed and dump valves therein. The steam supply pressure to the packing rings 240 may be varied, and hence the position of the packing rings 240, by actuating the feed and dump valves as desired. Many other types of actuating mechanisms may be used herein.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A variable steam seal system for use with a steam turbine, comprising:

a seal steam header;

a first pressure section;

a first pressure seal positioned about the first pressure section;

a flow path through the first pressure seal and extending to the seal steam header;

the first pressure seal comprising a moveable seal packing ring for varying the flow path through the first pressure seal to the seal steam header; and a load sensor;

wherein the moveable seal packing ring varies the flow path through the first pressure seal according to the load on the steam turbine.

2. The variable steam seal system of claim 1, wherein the first pressure section comprises a high pressure section.

3. The variable steam seal system of claim 2, further comprising a second pressure section and wherein the second pressure section comprises an intermediate pressure section.

4. The variable steam seal system of claim 1, further comprising a plurality of pressure sections and a plurality of pressure seals in communication with the seal steam header.

5. The variable steam seal system of claim 1, further comprising a leak-off line upstream of the first pressure seal.

6. The variable steam seal system of claim 1, further comprising a leak-off line downstream of the first pressure seal.

7. The variable steam seal system of claim 1, wherein the first pressure seal comprises a minimum clearance position during a high load on the steam turbine.

8. The variable steam seal system of claim 1, wherein the first pressure seal comprises a maximum clearance position during a low load on the steam turbine.

9. The variable steam seal system of claim 1, wherein the moveable seal packing ring comprises a seal ring and a bypass circuit.

10. The variable steam seal system of claim 1, wherein the moveable seal packing ring comprises a lifting button and a seal carrier.

11. A method of operating a steam turbine at a substantially constant self-sealing load point, comprising:

monitoring the load on the steam turbine;

maneuvering a seal packing ring to provide a minimum clearance through a pressure seal during a high load operation; and maneuvering the seal packing ring to provide a maximum clearance through the pressure seal during a low load operation.

12. The method of claim 11, further comprising maintaining greater than about a ninety percent (90%) self-sealing load point across a plurality of loads.

13. A variable steam seal system for use with a steam turbine, comprising:

a seal steam header;

a high pressure section;

a high pressure seal positioned about the high pressure section;

a low pressure section;

a low pressure seal positioned about the low pressure section;

a first flow path through the high pressure seal and extending to the seal steam header;

a second flow path through the low pressure seal and extending to the seal steam header;

the high pressure seal and the low pressure seal comprising a moveable seal packing ring for varying the flow paths through the high pressure seal and the low pressure seal to the seal steam header; and a leak-off line upstream of the high pressure seal.

14. The variable steam seal system of claim 13, further comprising a load sensor and wherein the moveable seal packing rings vary the flow paths through the high pressure seal and the low pressure seal according to the load on the steam turbine.

15. The variable steam seal system of claim 13, further comprising a leak-off line downstream of the high pressure seal.

16. The variable steam seal system of claim 13, wherein the high pressure seal and the low pressure seal comprise a minimum clearance position during a high load on the steam turbine.

17. The variable steam seal system of claim 13, wherein the high pressure seal and the low pressure seal comprise a maximum clearance position during a low load on the steam turbine.

* * * * *